US006874968B2

(12) United States Patent
Schwartz

(10) Patent No.: US 6,874,968 B2
(45) Date of Patent: Apr. 5, 2005

(54) BINDER VIEW POCKET

(75) Inventor: David C. Schwartz, Southboro, MA (US)

(73) Assignee: Productive Environments, Inc., Framingham, MA (US)

( * ) Notice: Subject to any disclaimer, the term of this patent is extended or adjusted under 35 U.S.C. 154(b) by 0 days.

(21) Appl. No.: 10/006,726

(22) Filed: Dec. 3, 2001

(65) Prior Publication Data

US 2002/0089166 A1 Jul. 11, 2002

Related U.S. Application Data

(63) Continuation of application No. 08/763,551, filed on Dec. 10, 1996, now abandoned, which is a continuation of application No. 08/197,217, filed on Feb. 16, 1994, now abandoned.

(51) Int. Cl.[7] ..... B42F 13/00

(52) U.S. Cl. ..... 402/79; 40/778; 229/67.1; 281/38; 402/80 R; 493/356; 493/947; D19/33

(58) Field of Search ..... 402/79, 80 R; 281/15.1, 20, 21.1, 29, 31, 38, 42; D19/33; 40/359, 365, 768, 777, 778, 782–785, 787, 790, 792, 793, 704, 710; 229/67.1; 493/210, 214, 356, 947

(56) References Cited

U.S. PATENT DOCUMENTS

| | | | | | |
|---|---|---|---|---|---|
| 1,495,953 | A | * | 5/1924 | Dick | 281/31 |
| 2,517,535 | A | * | 8/1950 | Cross | 40/778 |
| D275,576 | S | * | 9/1984 | Kirk | D19/33 |
| 4,602,734 | A | * | 7/1986 | Thompson | 229/67.1 |
| 4,795,287 | A | * | 1/1989 | Friedman | 402/79 |
| 5,141,485 | A | * | 8/1992 | Welt | 493/210 |
| 5,503,328 | A | * | 4/1996 | Roccaforte et al. | 229/301 |

* cited by examiner

*Primary Examiner*—Monica S. Carter

(57) ABSTRACT

This invention relates to pockets for holding a single or a small batch of sheets of paper, and particularly to the construction of an enclosure which provides "direct write" storage and access for a top leaf enclosed therein, where one entry lip of the pocket is on a border of one edge of the pocket forming a "book edge" for retaining the margin side of a leaf, and dual corner tab pockets are on the opposing edge's corners for retaining one or both corners opposing the margin edge of said leaf, thereby allowing the secure entry of one or more leaves therein, allowing the encoding of the sequence position of the leaf when placed therein as to a place in either "last in first seen" or "last in last seen" position, offering secure sequential viewing along the book edge when the ends secured under the corner tabs are both free, and providing for direct writing on the surface of the top leaf when the pocket is laid face up.

3 Claims, 14 Drawing Sheets

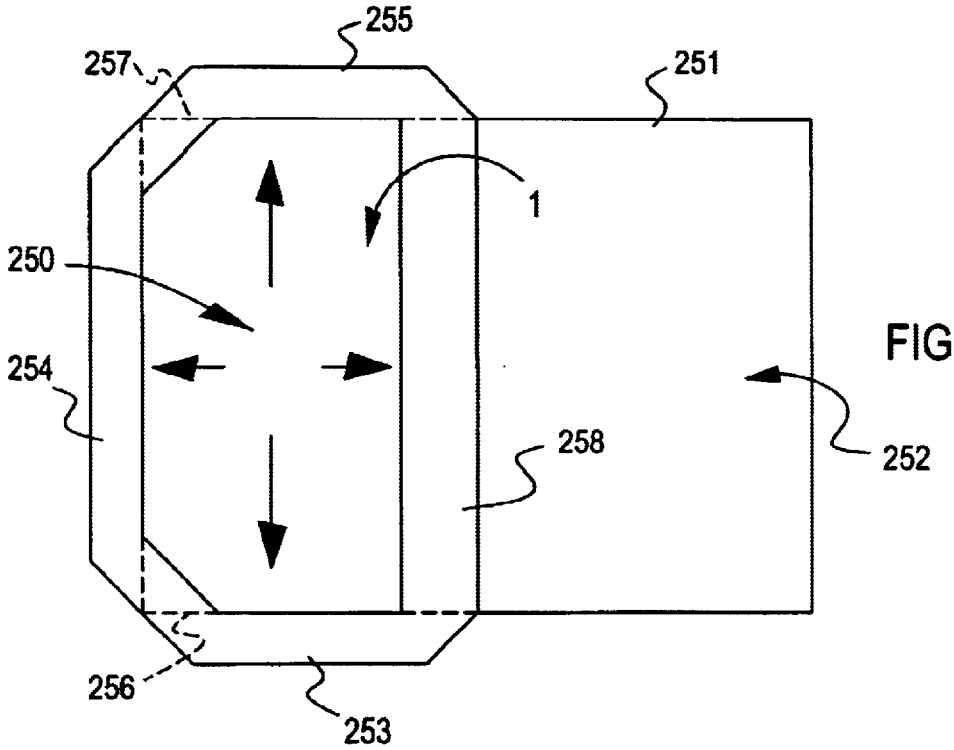
FIG. 9
FIG. 9a
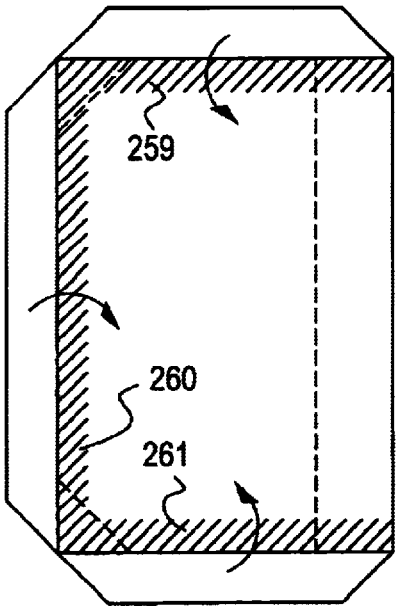
FIG. 9b
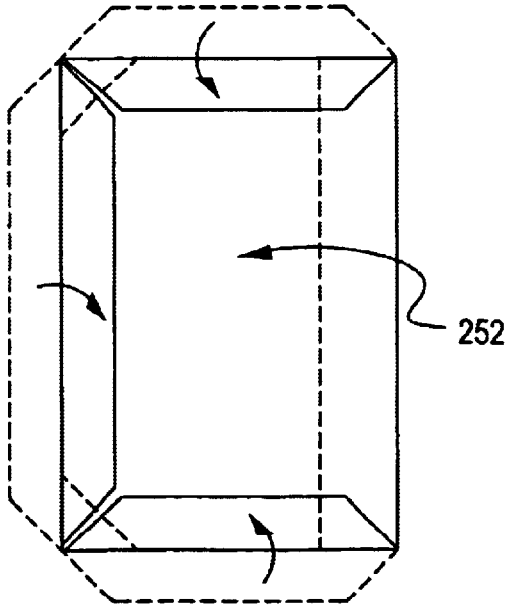

FIG. 12
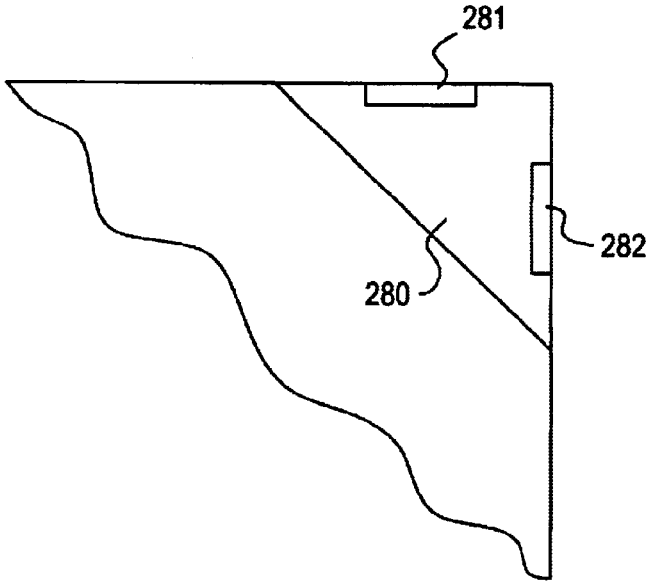
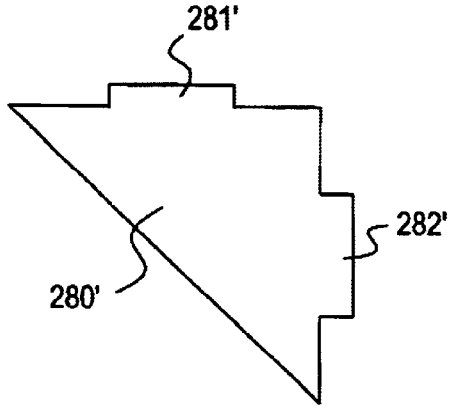
FIG. 13
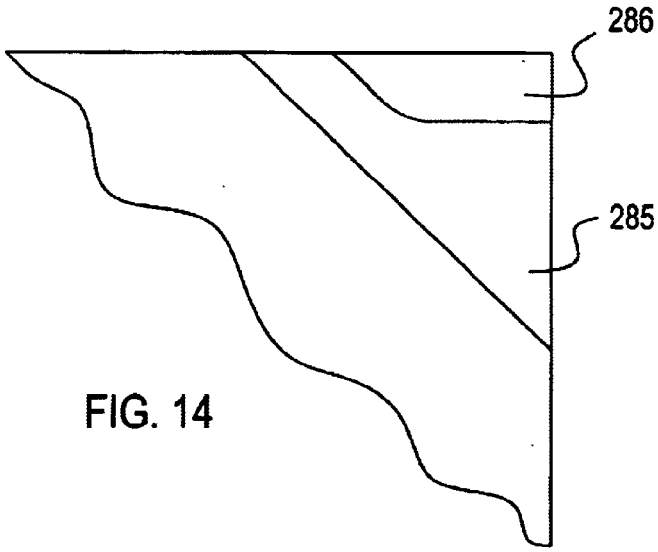
FIG. 14

BINDER VIEW POCKET

This application is a continuation of commonly assigned U.S. patent application Ser. No. 08/763,551 filed Dec. 10, 1996 now abandoned, which is a continuation of commonly assigned U.S. patent application Ser. No. 08/197,217, filed Feb. 16, 1994, now abandoned.

BACKGROUND OF THE INVENTION

This invention relates to pockets for holding a single or a small batch of sheets of paper, and particularly to the construction of an enclosure which provides "direct write" storage and access for a top leaf enclosed therein, where one entry lip of the pocket is on a border of one edge of the pocket forming a "book edge" for retaining the margin side of a leaf, and dual corner tab pockets are on the opposing edge's corners for retaining one or both corners opposing the margin edge of said leaf, thereby allowing the secure entry of one or more leaves therein, allowing the encoding of the sequence position of the leaf when placed therein as to a place in either "last in first seen" or "last in last seen" position, offering secure sequential viewing along the book edge when the ends secured under the corner tabs are both free, and providing for direct writing on the surface of the top leaf when the pocket is laid face up.

Small count multi-sheet pockets have been available which are formed with "picture tab" corners. Preferably for storing single sheets, small batches of sheets may be stored within them. In these types of pockets, the leaf is tucked under the corners and retained. This technique is used for pictures in a photo album. In addition, pockets with a strip edge on either side are used with similar success for holding single or small batches of sheets as seen on the panel of a book cover used as a menu or for retaining note cards, typically in a pocket size format. These pockets do not provide a book edge in combination with two corner tab pockets, and consequentially cannot provide for both secure sequential turning and the capability for placement marking as to last in first seen or last in last seen.

The pocket according to the invention provides a secure binding edge on the margin side of the leaf that is an elongated band that spans the complete margin of the host leaf and is enclosed to provide secure storage along that edge as well as to allow the temporary attachment of multiple leaves when the opposing edges are free and the leaves are turned as a mini-book. The dual corners provide secure storage for the leaf when both corners opposing the margin are enclosed thereunder, and offers a way to mark the chronological relationship of a leaf to a batch of leaves when one corner is left untucked. The untucked "state" is a sign that the leaf has been put in the order "last in first seen" and the dual tucked position is a sign that the leaves are all in chronological order "last in last seen." Of course, the opposite encoding can be used where one always stacks for the objective of "last in last seen" and always tucks both corners. Any of the currently known pocket styles can support this as well. If, however, one wants to always keep the stack referential in chronological order of capture, and this is the intended semi-permanent state of storage of a leaf, and uses the pocket configuration for only temporarily holding pages out of order, in a temporary state(one corner untucked) until properly placed in chronology(marked by being placed below the batch of leaves with both corners tucked) then a pocket of the kind in this invention is necessary. The advantage offered by the combination of bindings further ensures that all the leaves are secure from adhoc dislocation, whether encoded and placed in "temporary" or semi-permanent holding position. Unbinding the upper corner or lower corner leaves that corner of the leaf or leaves free to "peel". Unbinding both tucked corners allows for mini-book turning of all of the leaves which are each held along the "book binding edge". The top surface can sustain direct writing on the entire writing surface thereof. A small batch, secure locking pocket, with multiple sheet interrogation at a corner, and further having direct write on for the top leaf has been unavailable.

The advantage of the bookbinding pocket of this invention is the ability to construct the device on high speed folder/gluer equipment. Forming the pocket where the glue lines are parallel and where the glue on both parallel edges can be applied a the same location in the production line, at the same time, on opposing edges is an advantage in cost reduction to the production. The pattern employed in this configuration minimizes material waste while permitting the formation of the opposing pocket sets without requiring that the pocket pattern be flipped over.

The advantage of sealing the portion of the binding edge where a pattern of removable holes is positioned permits the formation of a removable hole with the added strength of the bonded material surrounding it. This lets the hole be reused many times without fatiguing.

A slice cut in the margin band permits one half page flipping forward of a stack of retained leaves while retaining the page turning property of the original book binding edge.

The use of slots to hold a refillable label strip permits relabeling of the pocket and reuse without permanently marking the pocket as would the corner tab label insert or the provision of a corner with a cut out so that the top sheet could be labeled and viewed through the cut out.

Forming the book binding pocket with a window adapter or integrally sectioning out a portion of a window adapter from the pocket itself allows the pocket to be attached to a number of different host products.

SUMMARY OF THE INVENTION

The invention therefore relates to pockets, and in particular to a pocket capable of grouping a single leaf or a small batch of leafs, where the binding edge for holding the margin is an enclosed band of a length substantially the length of the margin of the leaf to be held, and the opposing corners of the pocket provide tabs for tucking the leaf in place, thereby preventing the leaves from being dislodged in an adhoc manner.

The invention further relates to the construction of a pocket of the above kind where the margin edge of the pocket has a binding means formed with a cut pattern, typically a pattern of holes, to allow one or more of the pockets according to the invention to be combined into a set.

The invention relates to the construction of a pocket where the binding edge that holds the margin is a band of suitable length to securely hold one or more leaves in place so as to permit mini-book turning and shuffling of the leafs one with respect to the other, when the opposing corners of the leaves are all free.

In particular, the invention relates to the construction of a pocket according to the invention, formed from one sheet of flexible material such as card stock, where the cut and fold pattern of the card stock allows for the formation of the complete pocket by a sequence of folds and a sealing step.

The invention relates to the construction of pockets of this kind from any flexible material such as spun olefin(tyvek™/

Dupont), polypropelene, vinyl, paper, plastic of other varieties or like and similar substances having a stiffness property ranging from flexible to subtly rigid and being bondable by way of adhesive tabs, electrical bonding, heat sealing, specialty gluing, stapling, and the like.

It is a further object of this invention to provide a pattern of material for forming the pocket which requires the minimum amount of material while requiring only two parallel folding steps and a single parallel sealing step without having to flip the pocket over.

An additional object of this invention is to provide a reinforced binding edge where a reusable, I.e. Reinsertable hole pattern may be placed so that the reinforced binding provides extra life to the insert pattern.

Additionally, folding patterns which hide the tabs are provided as well as a book binding edge that permits ½ page forward flipping. Ways to label the pocket without writing directly on the pocket are also provided for.

The formation of a book binding pocket as an attachable pop out pocket is also provided for. This configuration would be particularly useful for attaching a ream of loose sheets of paper to a host book. The individual top page would also be able to be pulled out, turned over, and reinserted into the pocket, thereby allowing the individual sheets to be written on both sides.

BRIEF DESCRIPTION OF THE DRAWINGS

The above and other objects and advantages of the invention will be apparent from consideration of the following drawings taken to conjunction with the detailed description following these drawings, in which like reference characters are used to refer to like parts and in which:

FIG. 9 shows an alternative pattern for forming a book binding pocket where the tab edges are hidden and where a minimum number of tabs are used.

FIG. 9*a* shows the pattern of FIG. 9 where the base panel is flipped side ways onto the "picture frame" portion of the pocket.

FIG. 9*b* shows the pattern of FIG. 9A after the two fold and glue steps.

FIG. 10 shows a book binding pocket having a slit middle there in.

FIG. 12 shows a corner tab having a cut out retaining slot and a cut out marking slot.

FIG. 13 shows an insert for a corner like that in FIG. 12 where a lock tab is complemented by a label tab portion.

FIG. 14 shows a corner tab where there is a cut out portion for permitting the direct marking of the top sheet without having to write on the pocket itself.

DETAILED DESCRIPTION OF THE INVENTION

Figure 1:
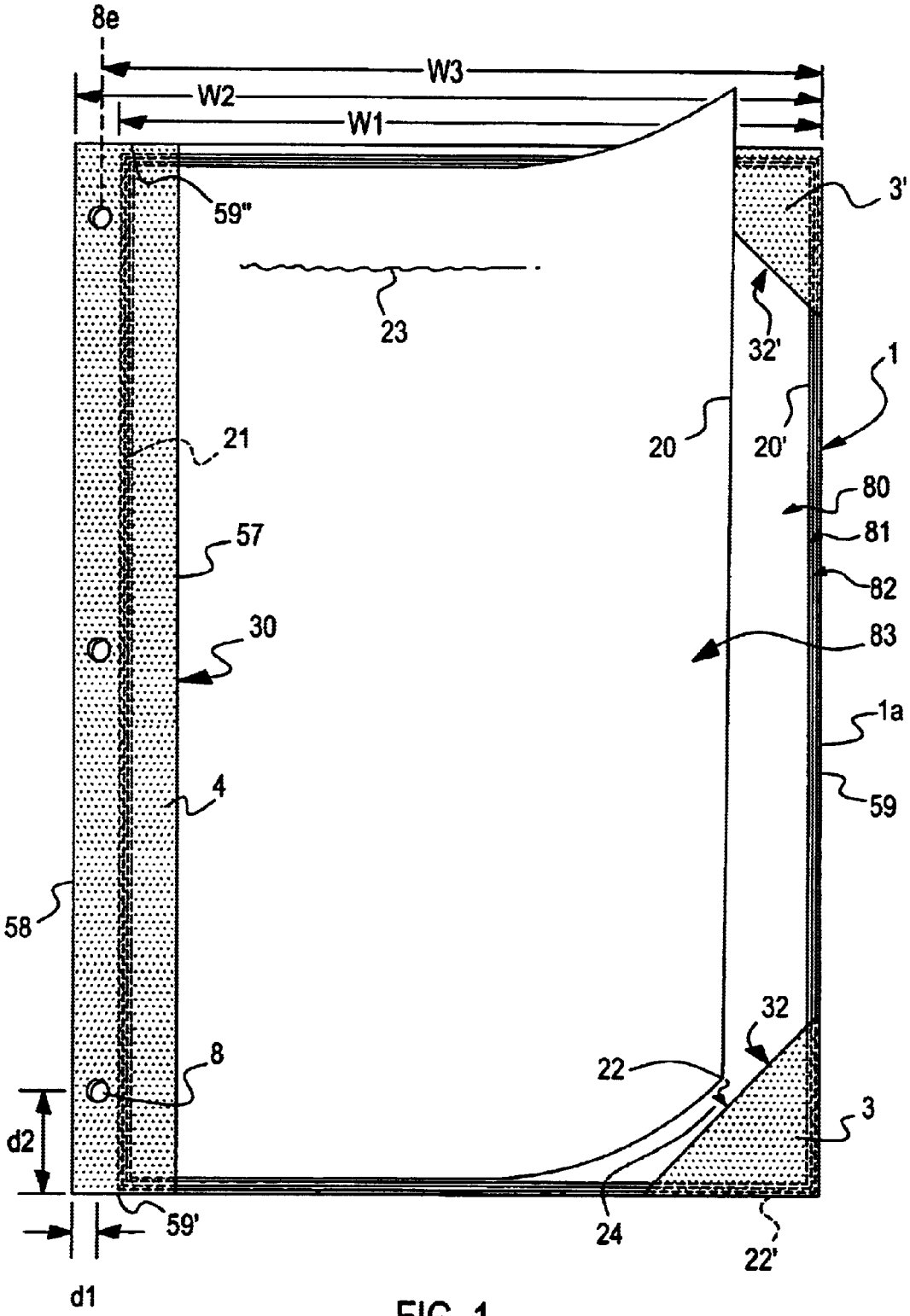
FIG. 1 Shows the front view of a pocket with three hole punches on the the binding edge, and dual corner pockets for securely holding a leaf, and further shows a leaf peeled at both corners.
Figure 5:
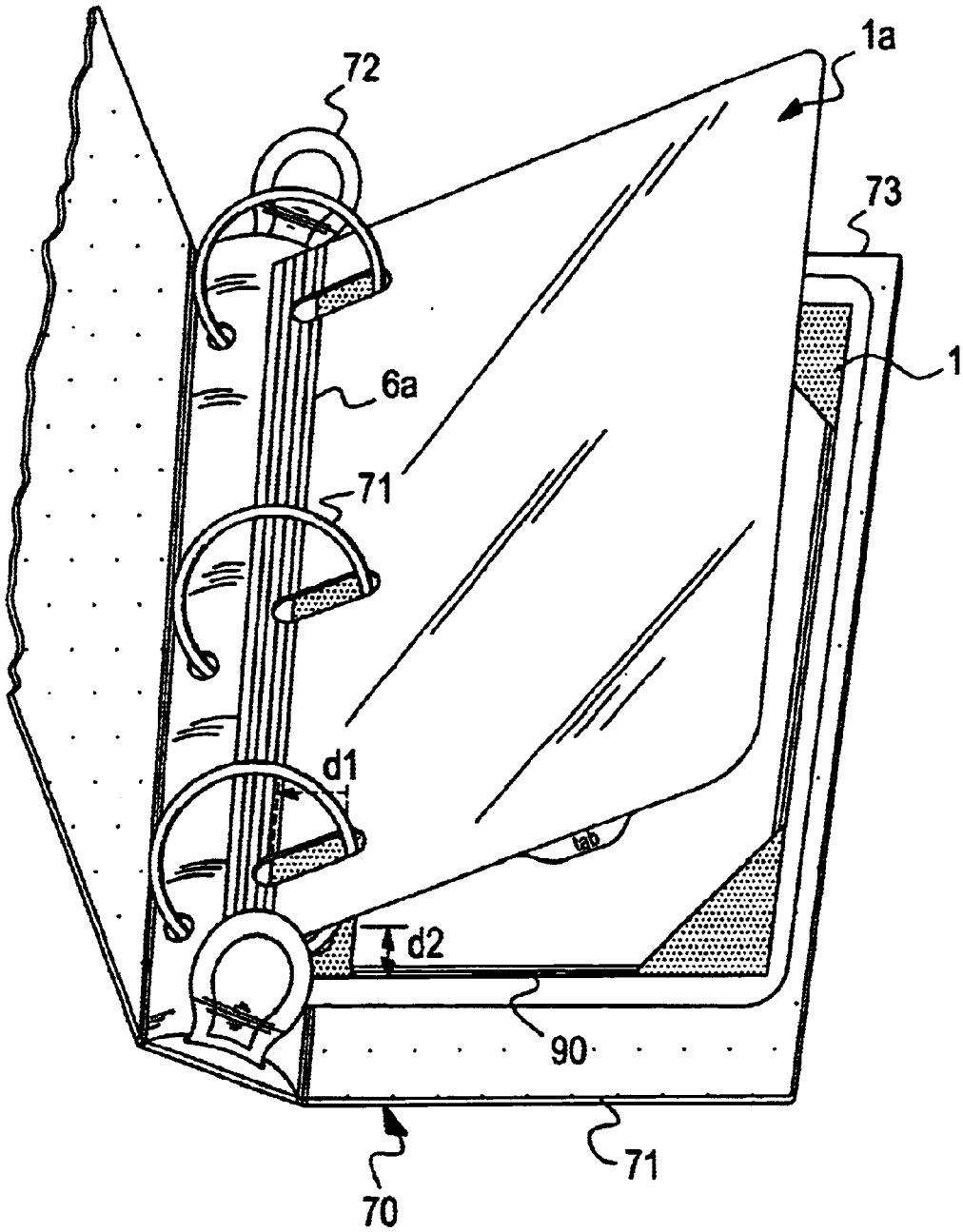
FIG. 5 Shows a perspective view of a host binder in which the pocket according to the invention is shown inserted between the covers of an encasing pocket.

FIG. 1 Shows the front view of a pocket, 1, with three holes, 8, punched on the the binding edge having band, 4, and dual corner pockets 32 and 32' formed by tab corners, 3 and 3', for securely holding a leaf 20, and further shows the leaf, 20, peeled at both corners. Said band 4 is forms a pocket 30 where said band has opposing top and bottom ends, 59' and 59", and opposing edges, an inner edge 57 and an outer edge 58, with the top and bottom ends and the outer edge being attached to base panel 1*a*, thereby leaving edge 57 unattached to form a pocket, the book binding structure. The corner binding edge, 59 has two pockets formed thereon, a top corner pocket 3' and a bottom corner pocket 3. Each triangular corner pocket has two edges attached to the base panel and a free lip 32' and 32 which forms the pocket structure. Corner 22 is shown by motion 24 to be able to be alternatively tucked under corner pocket 32 for "encoding" as to it's state of capture. In the preferred use, when one or more leaves have both their corners free and only the margin is held below band 4, the leaves are in mini-book mode for sequential visual scanning, when all leaves have their corners tucked, then the leaves are in chronological sequence, i.e. last in last seen, and when a leaf or leaves have the upper corner untucked, it is in a temporary state of last in first seen and is awaiting shuffling to the bottom of the batch, into last in last seen position. The other leafs of the batch, are below and edge 20', for example has both corners tucked. So, leaves 80, 81, and 82 are in chronological order, last in last seen, and leaf 83 is about to be placed in last in first seen position, with it's bottom corner tucked and it's top corner untucked. Edge 58 is the "book edge" and has a band 4, for securing a batch of leaves. The leaf has a width W1 which is shorter than the pocket width W2 by an amount which permits the formation of a binding region where, holes 8, are formed to enable attachment of the pocket to a host binding. D1 is narrow to allow for cocooning as shown in FIG. 5. D2 is short to allow for bottom edge indexing of and enclosing cocoon as shown in FIG. 5. W1 is the width of a typical leaf and is less than w3, the distance from the tab edges to the holes, 8. W2 is the width of the base panel 1*a*.

Figure 2:
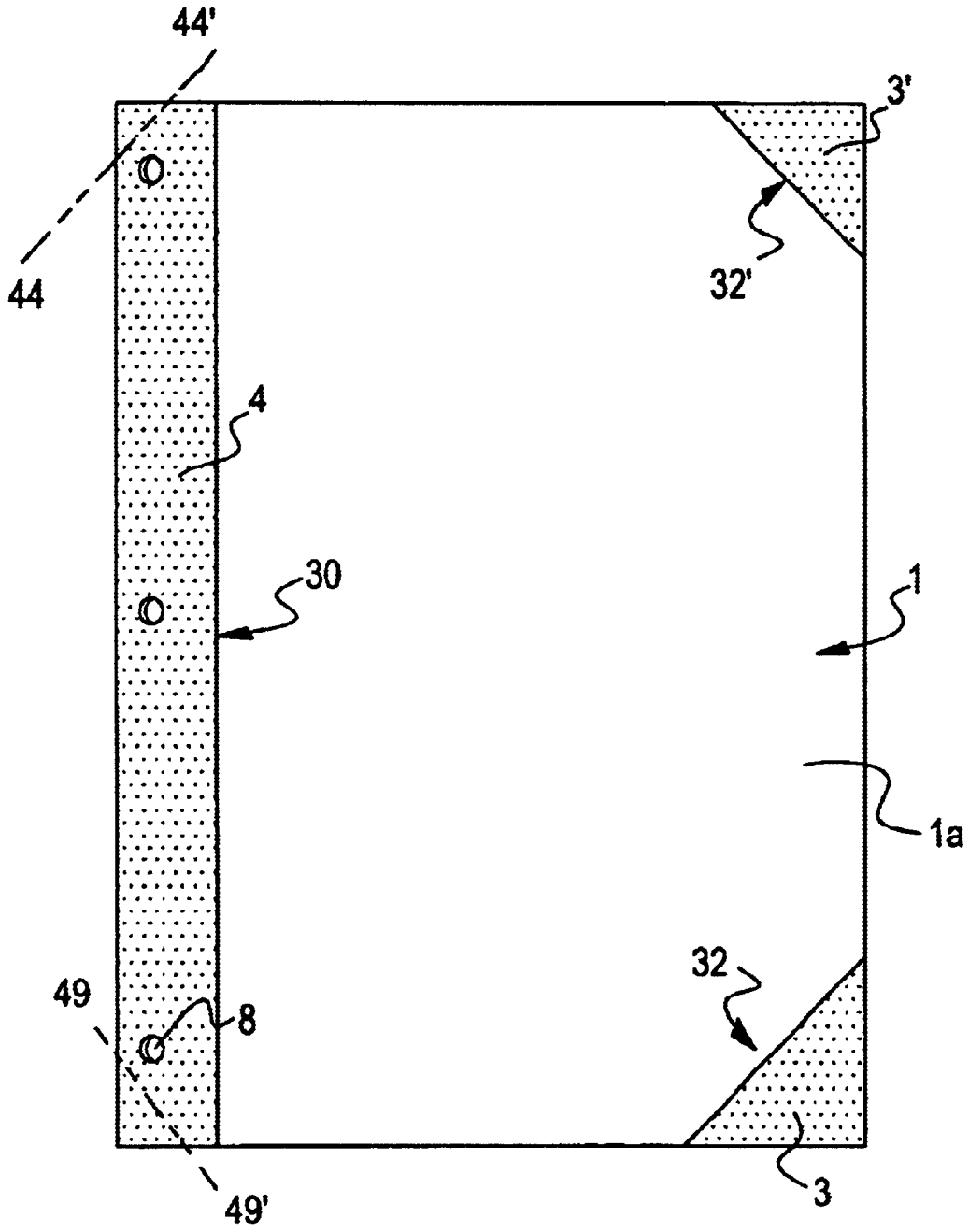
FIG. 2 Shows the front view of the pocket with the leaf removed.

FIG. 2 Shows the front view of the pocket, 1, having back or base panel 1*a*, with the leaves removed. The band 4 can be sealed onto the back panel 1*a*. Each material and means for forming the pocket portions would result in a different structural version of the same species of pocket. So corners 3' and 3 can also be made integrally as part of a folding pattern off the base die, can be "welded on", or can be attached as separate mini-tab pockets, for example. If this is done, it is desirable to attach the mini-tab pocket which would be triangular in shape so that the base panel 1*a* joins the interior corners of the mini-tab to allow a smooth base panel. The smooth base panel is needed under all pockets so that a first leaf can be slid into the pocket formation without a hitch. The diagonal cuts 44/44' and/or 49/49' are optional.

Figure 2A:
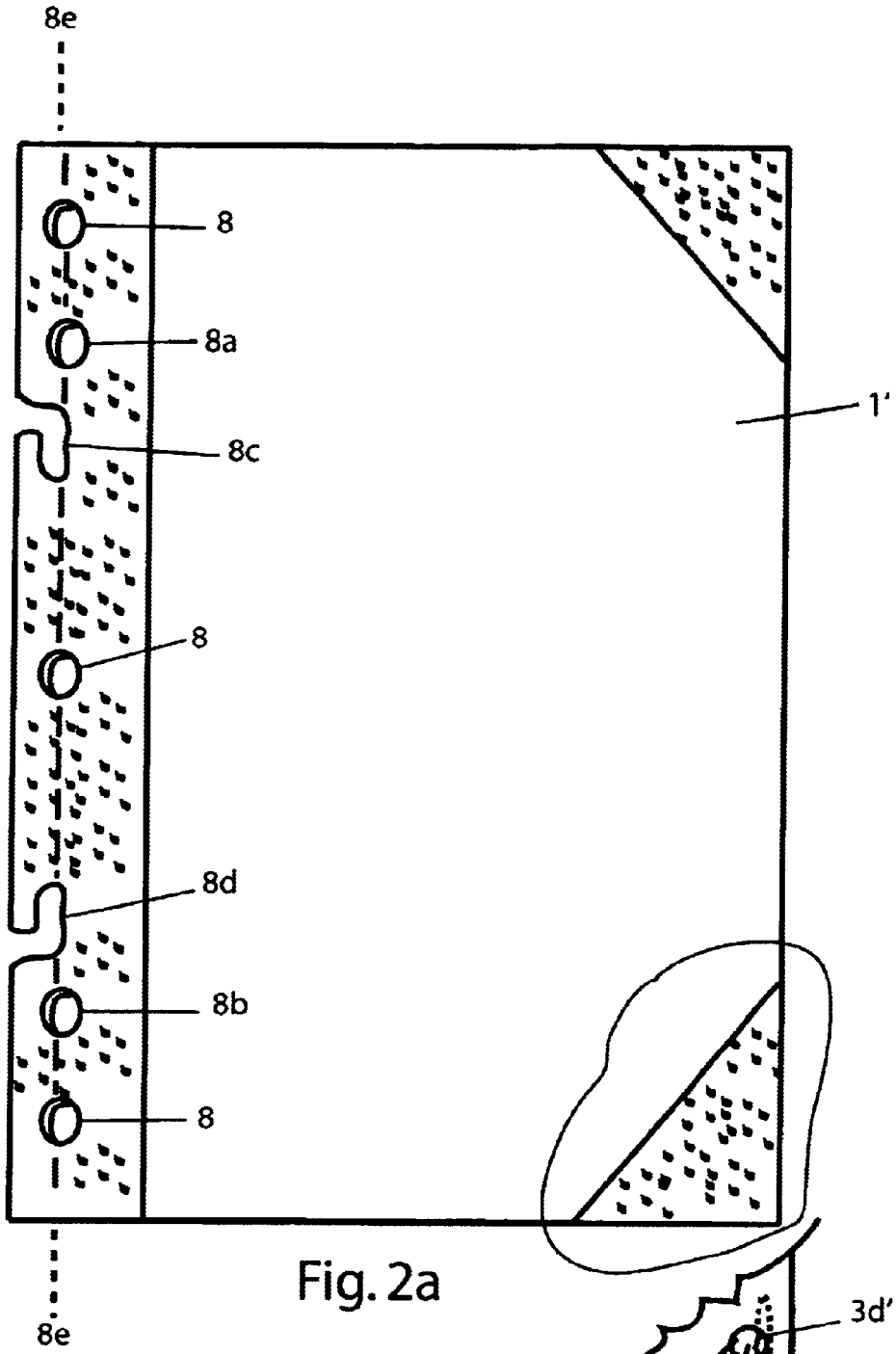
FIG. 2*a* Shows the front view of the pocket with the leaf removed where the pocket is shown to have alternative forms of mini-booking secondary binding structures.

FIG. 2*a* Shows the front view of the pocket, 1', with the leaf removed where the pocket is shown to have alternative forms of mini-booking secondary binding structures. Hook cut pattern 8*c*/8*d* can be used with an elastic band to group pockets of this type into batches. Alternatively, one or both of holes 8*a*/8*b* could be used with one or two fasteners such as butterfly clips, to group batches of pockets. Either one or both kinds of "secondary binding structures" can be present, or any other similar kind of structure to allow grouping of pockets without a host ring binder, and still be in the scope of this invention.

Figure 2B:
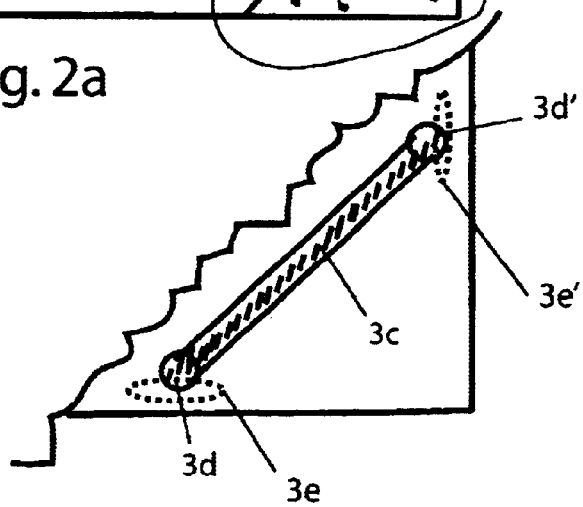
FIG. 2*b* Shows an alternative corner formed from an elastic band with two clips inserted into respective holes diagonally punched at a distance substantially the length of the elastic band.

FIG. 2*b* Shows an alternative corner formed from an elastic band, 3*c*, with two clips 3*e* and 3*e*' affixed at each end thereof, and inserted into respective holes, 3*d*' and 3*d*, diagonally punched at a distance substantially the length of the elastic band, away from each other. The band is stretched to latch over corners of leaves inserted below.

Figure 3:
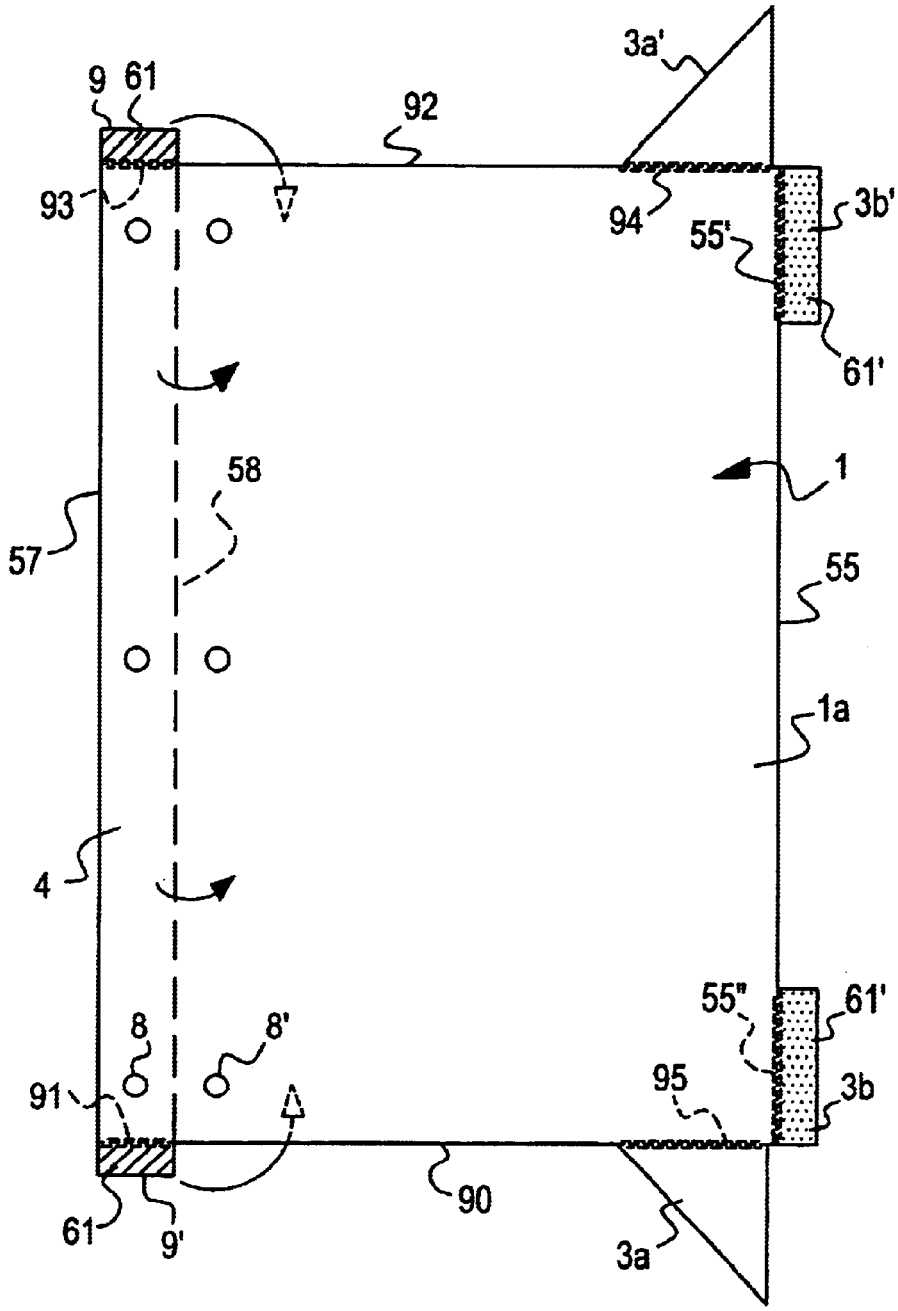
FIG. 3 Shows an unfolded view of one form of construction having dual corner tab portions which combine to form a corner pocket and having a band formed from a section of material spanning the height of the base panel and having tab portions and a symmetrical hole pattern for attachment to a host binding.

FIG. 3 Shows an unfolded view of one form of construction having dual corner tab portions, 3*a*'/3*b*' and 3*a*/3*b* which each combine to form the corner pockets. The tabs may be "welded" together to make a triangular pocket or can have adhesive on either portion or both, for attachment. The band, 4 is shown as being formed by folding edge 57 over line 58 to place the holes symmetrically one on top of the other. The holes can be punched after ward. Tabs 9 and 9' have adhesive 61 for bonding the tabs respectively to the back portion of the panel 1*a*, leaving a pocket, 30, formed thereunder, and forming a band as a section of material spanning the height of the base panel 1*a*. Each of the tabs has an optional expansion area shown as 91, 93, 94, 55', 55", and 95. The adhesive 61' is used to seal the tabs 3 and 3*b*' onto 3*a* and 3*a*'.

Figure 3A:
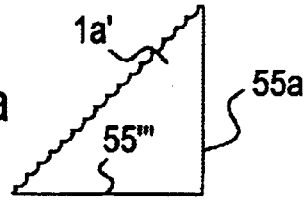
FIG. 3*a* Shows an alternative corner construction with a band formed by a strip which is folded over and adhesive attached to the edge of the base panel.

FIG. 3*a* Shows an alternative corner construction with a band strip 3*a*", formed by a strip which is folded over edge 90', and adhesively attached by adhesive 61" on tab 3*b*'", to the edge 55*a*, of the base panel, 1*a*'. Optional expansion hinge sections 55'", and 55"" allow for the band strip to accept a larger number of leaf corners.

Therefore the corners each have "enclosures" which allow the leaf corners to be held securely but temporarily. The rubber band, strip band, corner pocket die cut patterns each showing examples of corner enclosures which enclosures may be formed by similar construction and still be within the scope of this invention.

Figure 4:
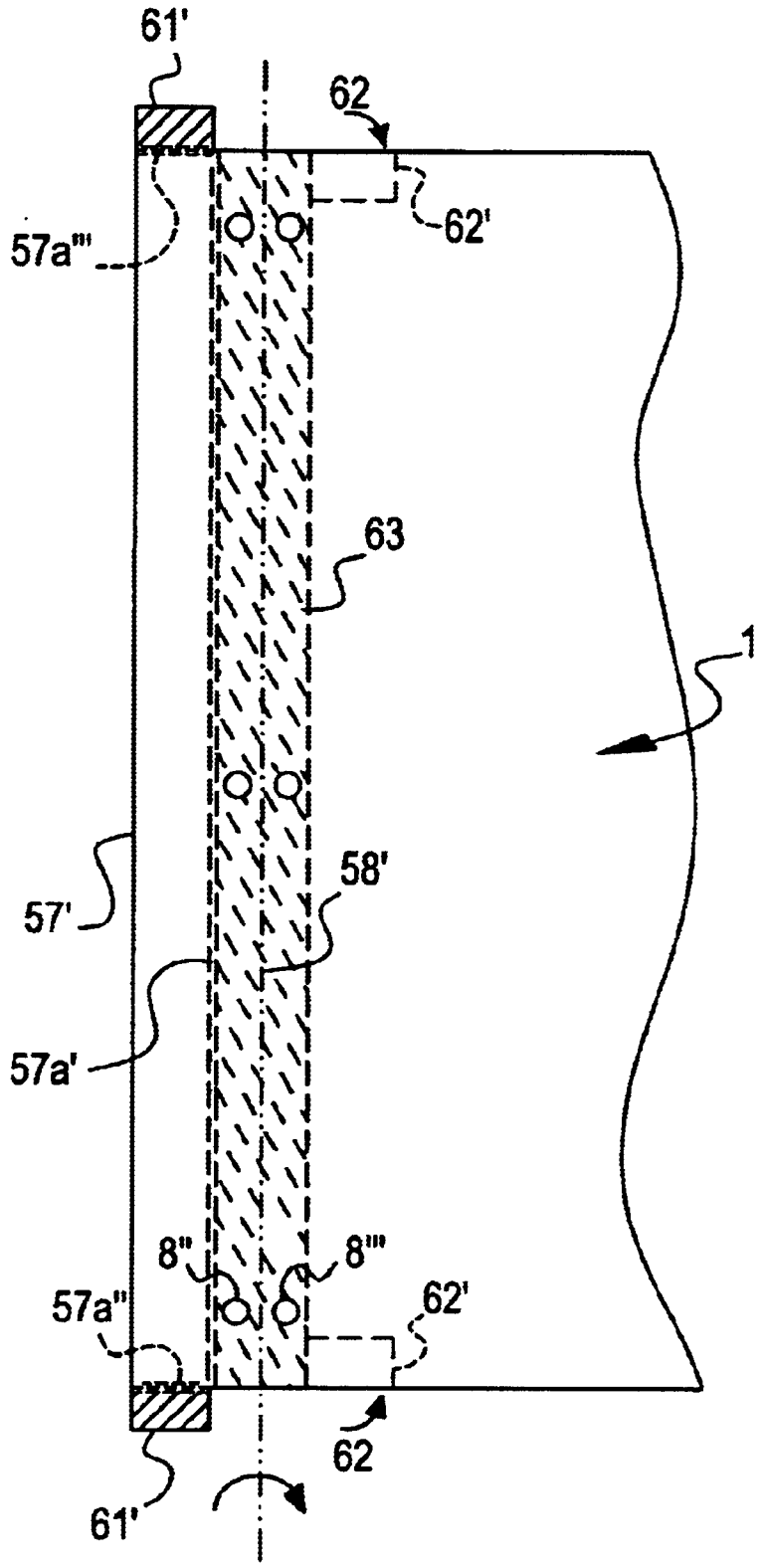
FIG. 4 Shows the unfolded part of one form of construction of the binding edge of the pocket for holding the margin edge of the leaf to be held therein, where the symmetrical hole portion is adhesively attached one side to the other and the band is formed adjacent thereto.

FIG. 4 Shows the unfolded part of another form of construction of the binding edge of the pocket for holding the margin edge of the leaf to be held therein, where the symmetrical hole portion 8" and 8'", is adhesively attached with a span of adhesive 63 over the area which folds to form a sealed hole binding strip, from one side to the other and the band is formed adjacent thereto with edge 57' forming the entry lip therefore. Expansion strip 57*a*' allows for the band to hold a larger number of leaves, where 57*a*" completes the expansion strip to allow uniform expansion of the band to occur. Here, the tabs have adhesive 61' which attaches to portion of the back panel of 1' at locations 62.

FIG. 5 Shows a perspective view of a host binder, 70, having a bottom edge 71, in which the pocket according to the invention, 1, is shown inserted between the covers of an encasing pocket, 1*a* and where said distance d2 is set so as to permit the bottom edge of said book edged pocket to be retained substantially offset from said bottom edge of said ring binder. This demonstrates the formation of a cocoon, where the "book binding edged pocket" is categorized by the encasing dual pocket folder. The top or bottom horizontal edge of the binder can be the point of reference for the offset of the horizontal top or bottom edge of the book binding pocket, i.e. indexing of the enclosing cocoon and or the pocket itself can be on the top or bottom edge. The idea is to have the book binding pocket retain a standard leaf batch (typically 8½ by 11 in USA) and still have the pocket, when encased in a cocoon with an index tab fit within the foot print of a closed standard 3 ring binder. The notion of standard is general here and the intention is to have the pocket fit in the foot print of the host binder.

The pocket can be made from a card stock, optionally in colored form where each pocket in a set can be a different color.

The bonding step will depend on the material used. Special adhesive is needed for Tyvek for example. Card-stock can be glued with commonly known adhesives. Plastic material can be chemically bonded, heat treated to bond, or can have its molecules electrically stimulated to bond, In one instance molecules are caused to bond by heat caused from a chemical reaction, and in the others, the process of "melting" bonds the fiber or radio frequency sealing bonds the materials. The result of attaching achieves a common purpose. Instead of tabs 9 and 9', other methods can be employed as have been detailed. The edge which those tabs close can also be "fastened" by staples, stitching, or other similar methods to close, for example.

The application of this pocket and, in particular, the set of pockets taken together, is to enable a batching of record information about a variety of categories, each pocket according to the invention holds leaves, and where the state of "order" of the leaves in each pocket, can be marked by the manner in which the corners opposing the margin edge of the leaf are positioned with respect to the pockets subpocket portions.

In FIG. 2, optional angle cuts 44/44', and 49/49', allow for the use of this pocket in a ring binder and enable the pocket to miss the ring binder clips any cut pattern may be used to clear the tabs. The use of the book binding pocket within a cocoon, which is set within a ring binder is shown in FIG. 5. The hole distances d1 and d2 are particularly important for the preferred application of "cocooning". In cocooning, the book binding pocket will be placed within another enclosing pocket. The enclosing pocket will be retained in a standard ring binder of any ring dimension. Therefore, the offset distance d1 should be "narrow", allowing for retention of the pocket array as close to the ring binder as possible. Reinforcing the holes may be desirable to allow for the shortest realistic distance d1. Further d2 should be set to permit the bottom edge of the pocket 40 to reside on order of ½" from the bottom of the host ring binder. For this reason, 44/44' is slit to permit the top corner to turn freely past a host ring binders clips when present. The cocooning construction is fundamental to the application of this pocket configuration in what we are calling "Demand Paging" where one carries or moves around a set of leaves of paper which are related to "current transactions" and the objective for portability achieves the "10/90" rule where 10% of the "mission critical" information you need is available to you 90% of the time, in the cocoon configuration you have at your finger tips at that moment.

Demand paging allows leaves to move through the cocoon, and in particular the book binding pocket on an as needed basis, where as records recorded on the leaves "age" they can be moved in batches retained in their respective book binding pocket, to a respective archive for referential access. This movement can be effected by either lifting out the batches of leaves from the book binding pocket, or taking the book binding pocket with its leaves enclosed, and archiving the pocket batch. In the first case, demand paging occurs by shuffling the batch out of its pocket and performing a secondary binding operation. In the later case, the pocket is detached from it's primary binding and attached in some fashion whether by piling or some other form of more secure binding, to a secondary binding.

Figure 6:
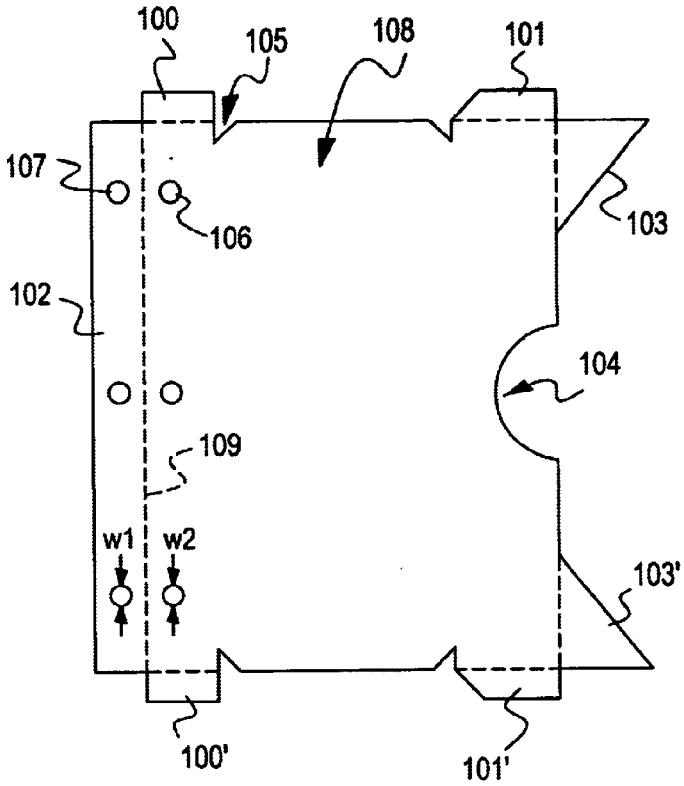
FIG. 6 shows a pattern of a bookbinding pocket that can be formed by a series of steps including a parallel fold, a parallel glue, and subsequent parallel fold requiring only one bump and turn but no flip over.
Figure 6B:
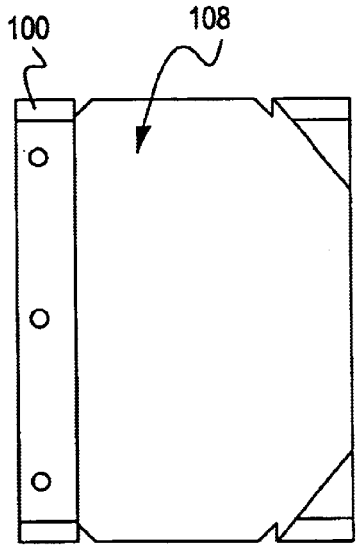
FIG. 6*b* shows the resulting pocket after the second parallel fold.
Figure 6A:
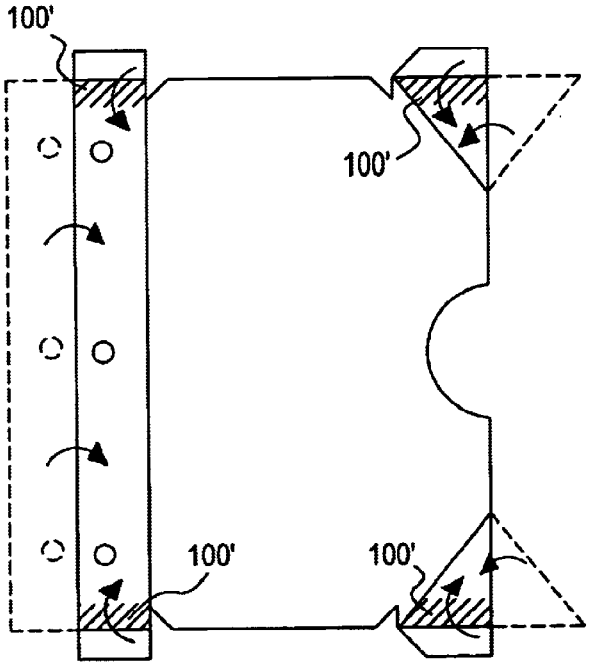
FIG. 6*a* shows the result of the first parallel fold and highlights the parallel glue and second parallel fold.

An additional group of preferred embodiments and alternative embodiments now follow. In FIG. 6, strip 102 and corner tabs 103 and 103' are folded over. Glue beads 110, 111, 110', and 111' are dropped and panel tabs 100, 101 and 100', 101' are folded over onto the glue and sealed. This formation is ideal for construction in paper board, where the glue is similar to a hot melt glue, and where the pattern is plow folded on opposing edges, bumped and turned, then glued and plow folded in line. Strip 102 forms the book binding edge. Tab portions such as 100 are visible on the front face of the pocket. Hole 106 on the backing panel is slightly oversized to compensate for any tolerance in folding if the holes are in the die. If the holes are punched, this type of formation is not applicable. The tab 5 may be glued in the alternative pattern thereby hiding the tabs. This would be done in such a way to prevent impedance to sheet insertion. Recessed tabs would allow this.

Figure 7:
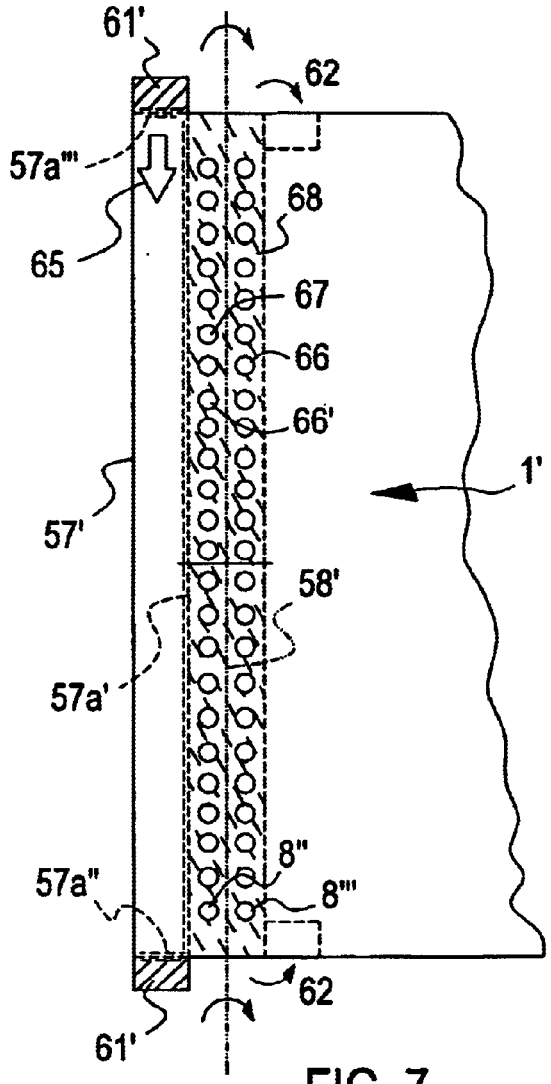
FIG. 7 shows a pattern for a reinforcable book binding edge with a reusable hole pattern. The cut out arrow indicates how to remove or insert.
Figure 7A:
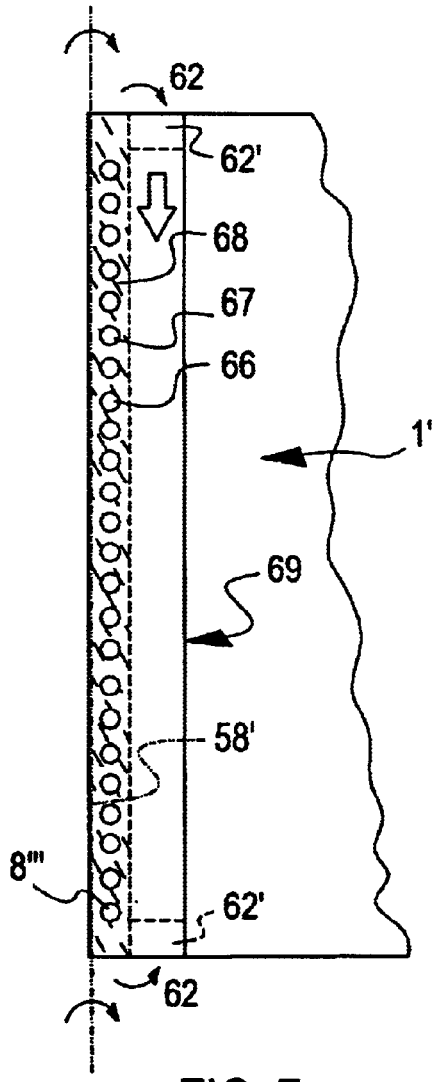
FIG. 7*a* shows the pattern of FIG. 7 folded over and bonded to form a reinforced hole edge. The pocket portion of the binding edge is retained.

FIG. 7 has a hole pattern 66, 66', 67 formed in a portion of the book binding edge reinforced by adhesive 68. When folded over, adhesive 68 forms a reinforcing strip portion while leaving the pocket portion 69 open.

Figure 8:
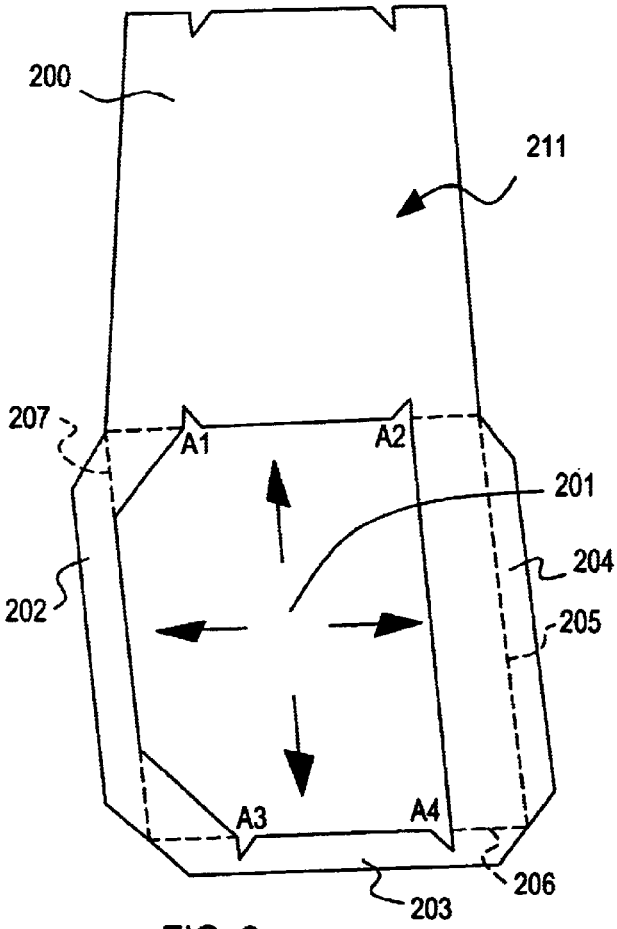
FIG. 8 shows a pattern for forming a book binding pocket where the tab edges are hidden and where a minimum of tabs are used.

FIG. 8 uses picture frame portion tabs 202, 203, and 204 to form a set of hidden folds using only 3 glue strips. The panel 200 is flipped up on top of the frame and the glue is applied and the tabs folded and sealed. Alternatively, RF or other bonding means can be employed depending on the material used.

Figure 8B:
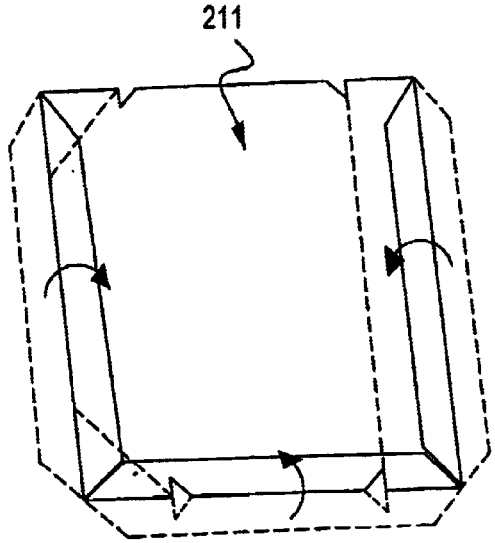
FIG. 8*b* shows the pattern of FIG. 8*a* after the two fold and glue steps.
Figure 8A:
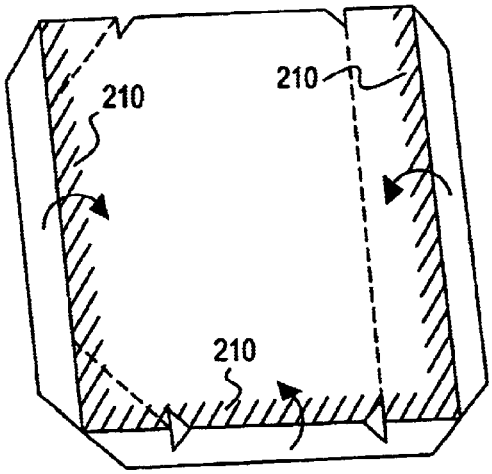
FIG. 8*a* shows the pattern of FIG. 8 where the base panel is flipped over on top of the "picture frame" portion of the pocket.

FIG. 8A shows glue portions 208, 209, and 210. FIG. 8*b* shows the completed pocket 211.

In FIG. 9, the formation is similar to FIG. 8 except that the panel is folded over the margin binding strip edge. Panels 255, 254, and 253 are folded over onto adhesive portions 259, 260, and 261. FIG. 9*b* shows the back portion of pocket 252 with three folded and hidden tabs.

Figure 10:
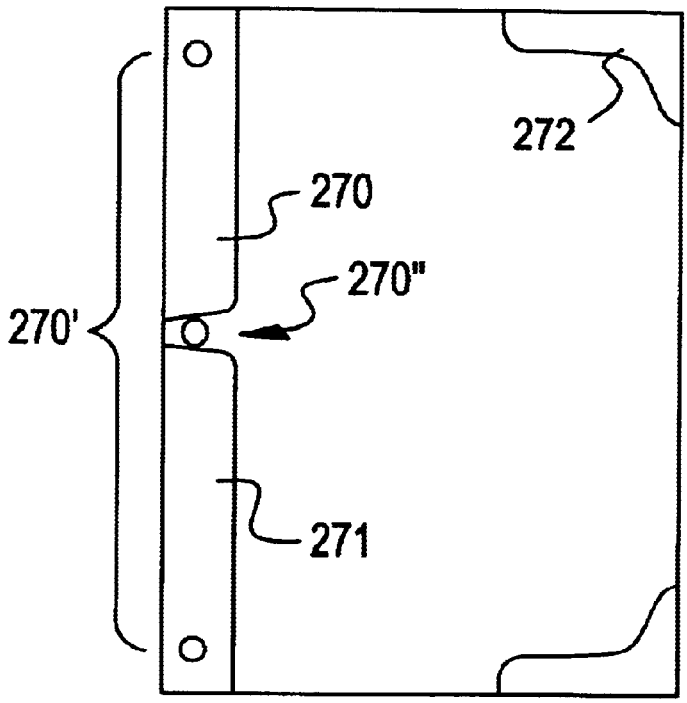

In FIG. 10, margin binding strip edge 270' is formed in two substantially adjacent portions 270 and 271. Slot 270" can be made larger while still retaining the properties of holding down the margin edge of leafs retained.

Figure 11:
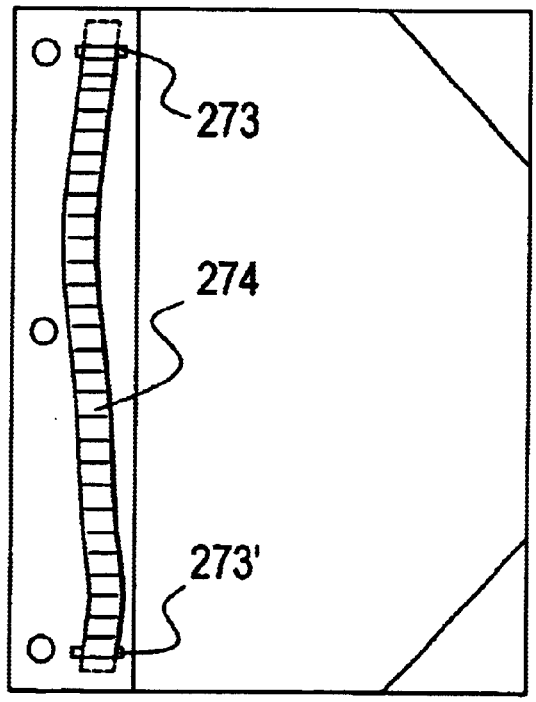
FIG. 11 shows a book binding pocket having a strip for labeling insertable into the margin portion of the book binding pocket.

FIG. 11 has slots 273 and 273' receiving label strip 274.

FIG. 132 has lock slot 281 receive lock table 281' of FIG. 13, and label slot 282 receive label portion 282' of 280'. One slot may be used or 2 label slots may be used.

FIG. 14 features a cut out portion 286 in corner 285. This can be done on top and or bottom corners and on any portion of the corner pocket to permit "write through labeling" directly onto the portion of the face sheet retained thereunder.

Figure 16:
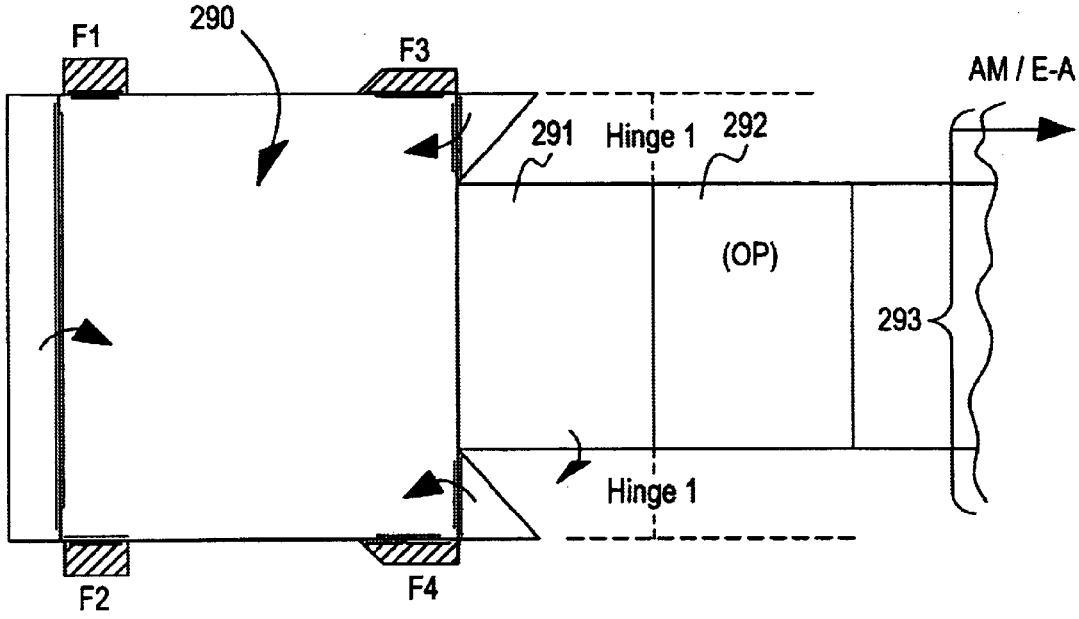
FIG. 16 shows a book pocket having a construction similar to that of FIG. 6, integrally formed with a mounting support surface, and orientation panel, and an optional extension panel.
Figure 16A:
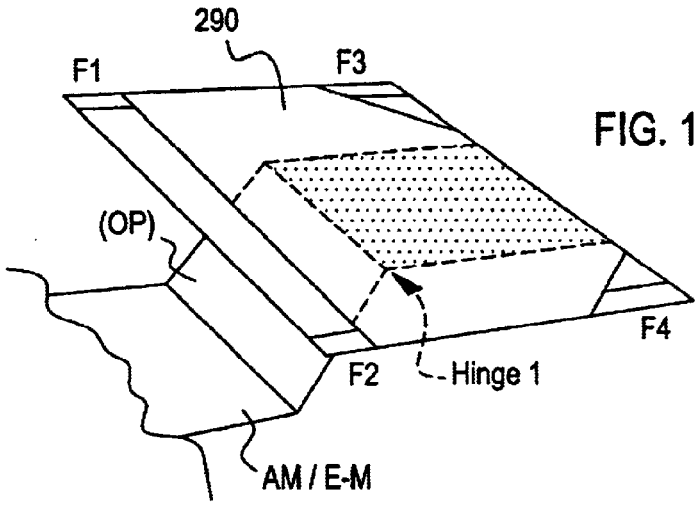
FIG. 16*a* shows the device perspective drawing of FIG. 16 when the pattern is "assembled".

In FIG. 16, and integral section of panels 281 and 292 and optionally 293 are formed off backing panel 290 for making a windowing book binding pocket attachment. FIG. 16A pocket 290 is the assembled figure with hinge 1 forming between opposing edges of the book binding pocket.

Figure 17:
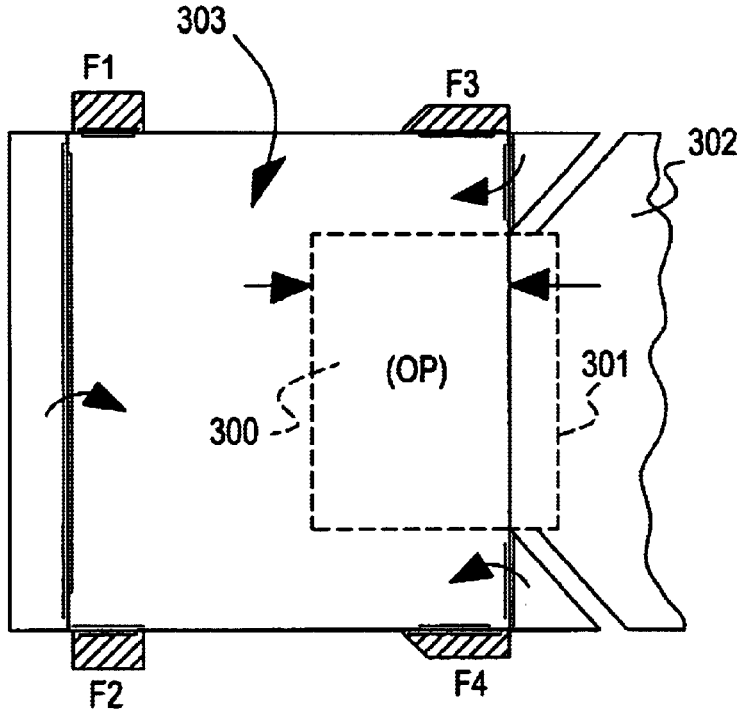
FIG. 17 shows an alternative to the construction of FIG. 16 where the orientation panel is formed from a portion of the base panel.
Figure 17A:
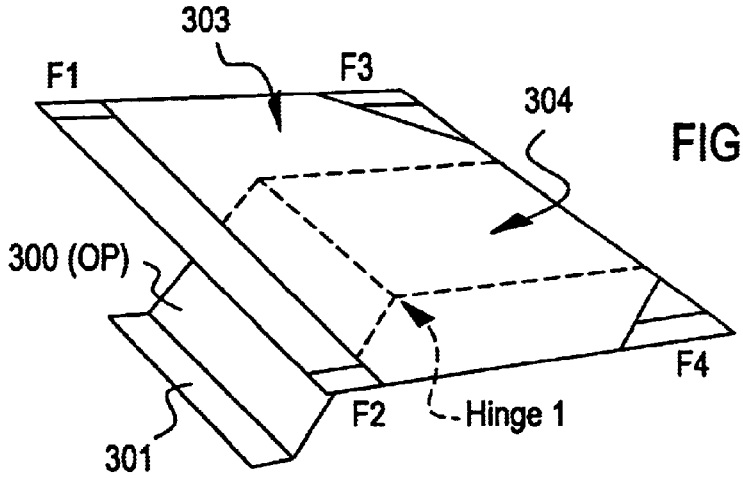
FIG. 17*a* shows the device perspective drawing of FIG. 17 when the pattern is "assembled".

In FIG. 17, the orientation panel 300 is formed directly in the back panel of pocket 303, formed as a portion of panel 300. Hinged binding strip 301 would be used to retain the assembly to a host.

One skilled in the art will appreciate that the present invention can be practiced by other than the embodiments described, which are presented for the purpose of illustration and not of limitation, and the present invention is limited only by the claims which follow.

What is claimed is:

1. A pattern for constructing a binder pocket for a ring binder, for viewing leaves which may be held within by using a book like page turning operation, said binder pocket pattern, therefore a book binding pocket pattern, said book binding pocket pattern formed from a single sheet of flexible, foldable material, for making a pocket comprising a band pocket and at least one opposing corner pocket, for holding a leaf having a set of perimeter features including opposing top and bottom height edges and opposing side width edges, a predetermined height, a predetermined width, said leaf further comprising a margin portion along one of said width edges as well as a face surface for writing on, said book binding pocket comprising:

a base panel, having a substantially rectangular shape, having perimeter and structural features including opposing corners, opposing height edges, opposing width edges, said opposing width edges comprising a book edge and a corner binding edge, said base panel having a band portion, a base portion, and at least one corner tab portion, and further having a band edge substantially side by side with and parallel to said book edge and inner and outer edge, where in said outer band edge is coincident with and co-linear with said book edge, for forming a closed outer edge of said band pocket, said base panel having a predetermined base panel height, and a predetermined base panel width between said book edge and said opposing corner binding edge, said predetermined base panel width being said pocket width, said base panel having a book binding structure formed along said book edge wherein, said book binding structure comprises a band pocket formed on said book edge said band pocket having dimensions including a predetermined height and a predetermined width said predetermined width substantially comprised of the sum of a binding region and a margin portion;

where in the width of the margin portion is substantially the width of the margin portion of a leaf to be held within, said predetermined height substantially spanning said predetermined base panel height, for holding said margin portion of said leaf thereunder;

and where in said binding region is longitudinally co-linear with said book edge and has a width substantially the difference between said base panel width and said predetermined width of a leaf to be held within said book binding pocket, which predetermined leaf width is less than said base panel width said binding region being comprised of symmetrical portions a first portion in said band portion of said base panel and a second portion in said base portion of said base panel on either side of said book edge, said each portion having a plurality of symmetrically opposing holes therein which holes align each one with the other when folded over and coincident one with each symmetrically opposing other one, for engaging a ring for holding said book binding pocket in a ring binder of which it may become a part;

said band further having perimeter features including opposing top and bottom ends, and opposing inner and outer edges, wherein said inner edge is coterminous with said base panel book edge for forming one closed side of said book binding structure, said base panel being further comprised of a set of opposing tabs formed along a portion of said base panel top and bottom edges and forming an integral part of said book binding structure, where in said top tab is for attaching said base panel to said top band edge and said bottom tab is for attaching said base panel to said bottom band edge for forming said band pocket of said book binding structure and for securing the second and third closed edges of said band pocket such that when said band is folded over for forming said band pocket said top tab permanently attaches said top band edge to said top base panel edge and said bottom tab permanently attaches said bottom band edge to said bottom base panel edge, thereby forming a first enclosed band pocket between said band and said base panel, said first enclosed pocket so formed being open along said inner edge of said band and comprising a non-interfering binding region for allowing said pocket to be held in a ring binder by a ring which may be attached through said symmetrically opposing holes, while at the same time holding any leaf which may be inserted there in, such that when said pocket is attached to a ring and said leaf is inserted therein, said leaf is held at said band pocket end without said leaf, itself, being attached to said ring;

said at least one corner tab portion for forming at least one of a top and a bottom corner pocket said each of said top and bottom corner pockets formed on adjoining corners of said base panel along said corner pocket edge, said at least one corner tab portion having perimeter features including three edges wherein two of said three edges are adjacent edges attached to said base panel at one of said corner pocket ends, said each of said two adjacent edges having dual overlapping portions for forming a corner pocket such that when said one of said dual overlapping portions is permanently attached to said other of said dual overlapping portions, a corner pocket is formed thereunder, said corner pocket having an open lip edge for receiving a corner of a leaf to be held thereunder when a leaf is placed into said book binding pock each corner pocket when formed being closed along said two adjacent edges and open along said open lip edge;

such that when said book binding pocket is formed by folding over and attaching said top tab from said too band to said top base panel, said bottom tab from said bottom band to said bottom base panel, and by attaching at least one set of said dual corner tabs of said at least one corner pocket one to the other, and when said book binding pocket so formed is held by one or more rings engaged in said binding region, and further a leaf is inserted in said book binding pocket with the margin portion of said leaf inserted under said band pocket, and at least one corner of said leaf inserted under said one of said each of said corner pockets for holding, said leaf margin edge is contained under said band tion with said plurality of holes remaining unobstructed by said margin edge of said leaf, such that said leaf when so attached, has secure entry in said book binding pocket within said book binding structure and at least one of said corner pockets, with said leaf face surface substantially exposed and accessible for direct writing, and when said at least one corner is released from said corner pocket, for turning as a page in a book said band pocket retaining said margin portion of said leaf with uniform pressure along said full margin portion, and further readily permitting continuous shuffling and reshuffling of one leaf below the next into the book binding pocket without having to open the rings when said booking binding pocket is so engaged with at least one said ring.

2. A binder pocket for a ring binder, for viewing leaves which may be held within by using a book like page turning operation, said binder pocket, therefore a book binding pocket, said book binding pocket formed from a single sheet of flexible, foldable paperboard material, for making a pocket comprising a band pocket and at least one opposing corner pocket, for holding a leaf having a set of perimeter features including opposing top and bottom height edges and opposing side width edges, a predetermined height, a predetermined width, said leaf further comprising a margin portion along one of said width edges as well as a face surface for writing on, said book binding pocket comprising:

a base panel, having a substantially rectangular shape, having perimeter and structural features including opposing corners, opposing height edges, opposing width edges, said opposing width edges comprising a book edge and a corner binding edge, said base panel having a band portion and a base portion, and further having a band edge substantially side by side with and parallel to said book edge and forming the outer most side edge of said base panel, said band having an inner and outer edge, where in said outer band edge is coincident with and co-linear with said book edge, for forming a closed outer edge of said band pocket, said base panel having a predetermined base panel height, and a predetermined base panel width between said book edge and said opposing corner binding edge, said predetermined base panel width being said pocket width;

said base panel having a book binding structure formed along said book edge wherein, said book binding structure comprises a band pocket formed on said book edge, said band pocket having dimensions including a predetermined height and a predetermined width said predetermined width substantially comprised of the sum of a binding region and a margin portion;

where in the width of the margin portion is substantially the width of the margin portion of a leaf to be held within, said predetermined height substantially spanning said predetermined base panel height, for holding said margin portion of said leaf thereunder;

and where in said binding region is longitudinally co-linear with said book edge and has a width substantially the difference between said base panel width and said predetermined width of a leaf to be held within said book binding pocket, which predetermined leaf width is less than said base panel width, said binding region being comprised of symmetrical portions a first portion in said band portion of said base panel and a second portion in said base portion of said base panel on either side of said book edge, said each portion having a plurality of symmetrically opposing holes therein which holes align each one with the other when folded over and coincident one with each symmetrically opposing other one, for engaging a ring for holding said book binding pocket in a ring binder of which it may become a part;

said band further having perimeter features including opposing top and bottom ends, and opposing inner and outer edges, wherein said inner edge is coterminous with said base panel book edge for forming one closed side of said book binding structure, said base panel being further comprised of a set of opposing tabs formed along a portion of said base panel top and bottom edges and forming an integral part of said book binding structure, where in said band is folded over and attached to the base panel such that said top tab is permanently and adhesively attached from said base panel to said top band edge and said bottom tab is permanently and adhesively attached from said base panel to said bottom band edge for forming said band pocket of said book binding structure and for securing the second and third closed edges of said band pocket, thereby forming a first enclosed band pocket between said band and said base panel, said first enclosed pocket so formed being open along said inner edge of said band and comprising a non-interfering binding region for allowing said pocket to be held in a ring binder by a ring which may be attached through said symmetrically opposing holes, while at the same time holding any leaf which may be inserted there in, such that when said pocket is attached to a ring and said leaf is inserted therein, said leaf is held at said band pocket end without said leaf, itself, being attached to said ring;

said book binding pocket further having at least one of a top and a bottom corner pocket said each of said top and bottom corner pocket formed on adjoining corners of said base panel along said corner pocket edge, said each of said at least one of said top and bottom corner pockets having perimeter features including three edges wherein two of said three edges are adjacent edges attached to said base panel, said each of said two adjacent edges having dual overlapping tab portions for forming a corner pocket where in said dual overlapping tab portions are folded over one on top of the other and permanently attached by adhesive with said one of said dual overlapping tab portions being permanently attached to said other of said dual overlapping tab portions, such that a corner pocket is formed thereunder, said corner pocket having an open lip edge for receiving a corner of a leaf to be held thereunder when a leaf is placed into said book binding pocket, each corner pocket when formed being closed along said two adjacent edges and open along said open lip edge;

such that when said book binding pocket is thus formed by folding over and attaching said top tab from said top band to said top base panel, said bottom tab from said bottom band to said bottom base panel, and by attaching at least one set of said dual corner tabs of said at least one corner pocket one to the other, and when said book binding pocket so formed is held by one or more rings engaged in said binding region, and further a leaf is inserted in said book binding pocket with the margin portion of said leaf inserted under said band pocket, and at least one corner of said leaf inserted under said one of said each of said corner pockets for holding, said leaf margin edge is contained under said band portion of said band pocket, with said plurality of holes remaining unobstructed by said margin edge of said leaf, such that said leaf when so attached, has secure entry in said book binding pocket within said book binding structure and at least one of said corner pockets, with said leaf face surface substantially exposed and accessible for direct writing, and when said at least one corner is released from said corner pocket, for turning as a page in a book said band pocket retaining said margin portion of said leaf with uniform pressure along said full margin portion, and further readily permitting continuous shuffling and reshuffling of one leaf below the next into the book binding pocket without having to open the rings when said booking binding pocket is so engaged with at least one said ring.

3. A binder pocket for a ring binder, for viewing leaves which may be held within by using a book like page turning operation, said binder pocket, therefore a book binding pocket, said book binding pocket formed from a single sheet of flexible, foldable poly plastic material, for making a pocket comprising a band pocket and at least one opposing corner pocket, for holding a leaf having a set of perimeter features including opposing top and bottom height edges and opposing side width edges, a predetermined height, a predetermined width, said leaf further comprising a margin portion along one of said width edges as well as a face surface for writing on, said book binding pocket comprising:

a base panel, having a substantially rectangular shape, having perimeter and structural features including opposing corners, opposing height edges, opposing width edges, said opposing width edges comprising a book edge and a corner binding edge, said base panel having a band portion and a base portion, and further having a band edge substantially side by side with and parallel to said book edge and forming the outer most side edge of said base panel, said band having an inner and outer edge, where in said outer band edge is coincident with and co-linear with said book edge, for forming a closed outer edge of said band pocket, said base panel having a predetermined base panel height, and a predetermined base panel width between said book edge and said opposing corner binding edge, said predetermined base panel width being said pocket width;

said base panel having a book binding structure formed along said book edge wherein, said book binding structure comprises a band pocket formed on said book edge, said band pocket having dimensions including a predetermined height and a predetermined width said predetermined width substantially comprised of the sum of a binding region and a margin portion;

where in the width of the margin portion is substantially the width of the margin portion of a leaf to be held within, said predetermined height substantially spanning said predetermined base panel height, for holding said margin portion of said leaf thereunder;

and where in said binding region is longitudinally co-linear with said book edge and has a width substantially the difference between said base panel width and said predetermined width of a leaf to be held within said book binding pocket, which predetermined leaf width is less than said base panel width, said binding region being comprised of symmetrical portions a first portion in said band portion of said base panel and a second portion in said base portion of said base panel on either side of said book edge, said each portion having a plurality of symmetrically opposing holes therein which holes align each one with the other when folded over and coincident one with each symmetrically opposing other one, for engaging a ring for holding said book binding pocket in a ring binder of which it may become a part;

said band further having perimeter features including opposing top and bottom ends, and opposing inner and outer edges, wherein said inner edge is coterminous with said base panel book edge for forming one closed side of said book binding structure, said base panel being further comprised of a set of opposing tabs formed along a portion of said base panel top and bottom edges and forming an integral part of said book binding structure, where in said band is folded over and attached to the base panel such that said top tab is permanently bonded from said base panel to said top band edge and said bottom tab is permanently bonded from said base panel to said bottom band edge for forming said band pocket of said book binding structure and for securing the second and third closed edges of said band pocket, thereby forming a first enclosed band pocket between said band and said base panel, said first enclosed pocket so formed being open along said inner edge of said band and comprising a non-interfering binding region for allowing said pocket to be held in a ring binder by a ring which may be attached through said symmetrically opposing holes, while at the same time holding any leaf which may be inserted there in, such that when said pocket is attached to a ring and said leaf is inserted therein, said leaf is held at said band pocket end without said leaf, itself, being attached to said ring;

said book binding pocket further having at least one of a top and a bottom corner pocket said each of said top and bottom corner pocket formed on adjoining corners of said base panel along said corner pocket edge, said each of said at least one of said top and bottom corner pockets having perimeter features including three edges wherein two of said three edges are adjacent edges attached to said base panel, said each of said two adjacent edges having dual overlapping tab portions for forming a corner pocket where in said dual overlapping tab portions are folded over one on top of the other and permanently attached by adhesive with said one of said dual overlapping tab portions being permanently attached to said other of said dual overlapping tab portions, such that a corner pocket is formed thereunder, said corner pocket having an open lip edge for receiving a corner of a leaf to be held thereunder when a leaf is placed into said book binding pocket, each corner pocket when formed being closed along said two adjacent edges and open along said open lip edge;

such that when said book binding pocket is thus formed by folding over and attaching said top tab from said top band to said top base panel, said, bottom tab from said bottom band to said bottom base panel, and by attaching at least one set of said dual corner tabs of said at least one corner pocket one to the other, and when said book binding pocket so formed is held by one or more rings engaged in said binding region, and further a leaf is inserted in said book binding pocket with the margin portion of said leaf inserted under said band pocket, and at least one corner of said leaf inserted under said one of said each of said corner pockets for holding, said leaf margin edge is contained under said band portion of said band pocket, with said plurality of holes remaining unobstructed by said margin edge of said leaf, such that said leaf when so attached, has secure entry in said book binding pocket within said book binding structure and at least one of said corner pockets, with said leaf face surface substantially exposed and accessible for direct writing, and when said at least one corner is released from said corner pocket, for turning as a page in a book said band pocket retaining said margin portion of said leaf with uniform pressure along said full margin portion, and further readily permitting continuous shuffling and reshuffling of one leaf below the next into the book binding pocket without having to open the rings when said booking binding pocket is so engaged with at least on said ring.

* * * * *